United States Patent [19]

Roloff

[11] 4,035,957

[45] July 19, 1977

[54] ENTRY OR PASSAGE DOOR, ESPECIALLY FOR SHOWER STALLS

[76] Inventor: Heinz-Rudolf Roloff, Marseillestrasse 53, D-4156 Willich - 1, Germany

[21] Appl. No.: 677,126

[22] Filed: Apr. 15, 1976

[30] Foreign Application Priority Data

Apr. 17, 1975 Germany ..... 2517038

[51] Int. Cl.[2] ..... E05D 7/08

[52] U.S. Cl. ..... 49/388; 49/505

[58] Field of Search ..... 49/388, 390, 380, 505, 49/402; 160/97; 4/169, 153, 154, 146

[56] References Cited

U.S. PATENT DOCUMENTS

| | | | |
|---|---|---|---|
| 2,727,596 | 12/1955 | Smith | 49/505 X |
| 3,562,955 | 2/1971 | Blomgren | 49/402 X |
| 3,750,737 | 8/1973 | Woodward | 160/206 |

*Primary Examiner*—Philip C. Kannan

*Attorney, Agent, or Firm*—Shlesinger, Arkwright, Garvey & Dinsmore

[57] ABSTRACT

The invention concerns an entrance- or passage door, especially for shower stalls, with frame and door plate, whereby the frame designed from rustproof material for width adjustability on the upper- and bottom surfaces consists of telescoping profile portions adjustable telescopically and then lockable and at least one longitudinal side has holders for mounting a fixed door panel, and installation arrangements are provided on the upper and bottom surfaces of the frame for suitable pivots adjustable on a hinged door panel portion.

13 Claims, 8 Drawing Figures

ENTRY OR PASSAGE DOOR, ESPECIALLY FOR SHOWER STALLS

Figure 1:
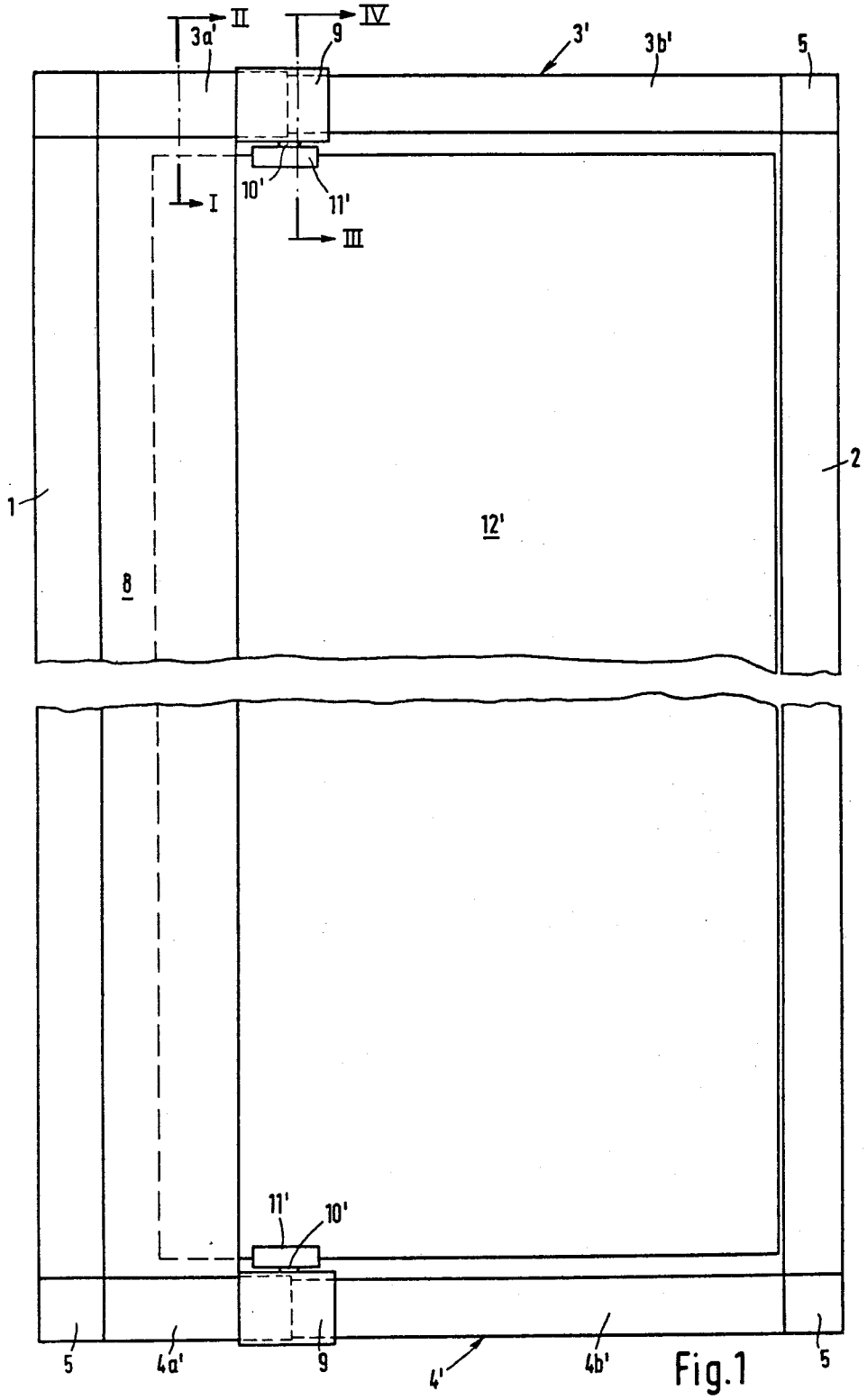

It has already been proposed that the installation arrangements for the pivots arranged on the hinged door panel portion each be arranged in a runner section which is supported adjustably on the upper and bottom surfaces of the frame in the profile portion, which is movable into the other profile portion on which the stationary door plate portion is secured. This basic conception has also been retained in the further development of this shower cabin door. But instead of the runner section, a tightly clamped sliding contact is used in the corresponding section which holds the pivot.

An adjustment to the width of passage opening then results so that first, the profile parts of the upper and bottom surfaces of the frame are correspondingly drawn far away from one another. Then the runner section, or sliding contact, is pushed back in the drawn-out profile portion until it is as near as possible to the free longitudinal edge of the stationary door panel portion and then stops. So that the hinged door plate portion also closes again completely, the pivot-which can be joined, for example, across a U-profile through clamping effect with the door panel part must be placed so far on the door panel part's upper and bottom edges until the hinged door panel part closes the passage opening completely.

For the adjustment of this entrance door to the width of the passage opening, a total of three adjustment procedures are thereby necessary. But this is relatively complicated. Furthermore, through the arrangement of the installation arrangements in sliding contacts, or runner sections, which must be supported adjustably in the respective profile portions, complicated specific embodiments of profile parts are necessary for the upper and bottom surfaces of the frame. In addition, these profile portions must be designed open so that in showering, the water which collects in them and which causes contamination and corrosion and leads, moreover, to leakproof problems on the contact points to the longitudinal sides of the frame, is drained.

Thus, it is the purpose of the invention to design and arrange installation arrangements for the pivots in such a way that the simplest profile portions possible can be used especially for the upper and bottom surfaces of the frame and work of adjustment on the width of the opening of passage be minimized.

This task is solved according to the invention in that the installation arrangements on the profile portions, which are directly secured on the longitudinal side of the frame with the anchoring arrangement for the stationary door panel part, are arranged in the vicinity of the free longitudinal edge of the stationary door panel part. In this way an act of adjustment in the fitting to the width of the opening of passage is eliminated. Through this arrangement in extending the upper and bottom surfaces of the frame, the installation arrangement is no longer relatively shifted to the stationary door panel part so that the replacement which previously resulted across runner sections, or sliding contacts, is no longer necessary. In addition, further possibilities for simplification result thereby, since the entire sliding mechanism for the installation arrangements can be eliminated so that the profile portions, thus previously constructed in so complicated a manner, can be replaced by correspondingly simple constructions.

In the design of the invention, it is provided that the length of the profile portions on which the installation arrangements are arranged is greater than the width of the stationary door panel part, but maximally corresponds to the width of the hinged door panel part. This extension of the profile portions, on which the holders are adjusted according to the invention, if first made possible in that the sliding mechanism for the holders is eliminated. The two-way guideway of the profile portions adjustable into one another is thereby improved, since the area of the overlapping can be enlarged. In addition, greater freedom in the design of the holders results, since the area of overlapping is no longer situated at the level of the holders.

In a further design of the invention it is proposed that the holders are designed as sleeves which enclose at least the profile portions secured on the longitudinal side with the anchoring arrangements for the stationary door panel part and are lockable with them. Adjustment can thereby result by shims arranged within the installation profiles which shims rest against the profile portions under clamping effect and receive the pivots.

According to a further proposal of the invention it is provided that the shims lie horizontally against the profile portions.

The invention further provides that the installation profiles include the outlet of the inner from the outer of the two telescoping profile portions slidable into one another and are lockable with both profile portions if the outlet lies in the area of a free longitudinal edge of the stationary door panel part. With the locking of the holder, both other profile portions which are movable into one another are thereby fixed together.

It is further proposed according to the invention that the holders and, if necessary, the clamping profiles are correspondingly adapted to the cross-sectional change at the outlet of the inner from the outer profile portion.

Alternatively to this type of holder, the invention provides that the holders be designed as center plates. These center plates can be inserted into the respective profile portions. In this form a very simple solution is found for the installation arrangements. If desirable because of space reasons, the center plates can be secured on the outer side of the respective profile portions.

According to a further proposal of the invention, the center plates can also be designed enclosed on their inner ends. This is particularly advantageous if they are inserted into the respective profile portions. Water is thereby prevented from penetrating into the profile portions when showering. Through elimination of the sliding mechanism for the holders, it is possible that, according to a further proposal of the invention, the profile portions and side portions of the frame are designed as closed hollow sections. In this way penetration of water into the profiles is impossible. Furthermore, simple standard profiles which reduce production costs can be used.

According to the invention it is further proposed that the hollow sections are designed in an L-form, whereby the section formed by both sides of the L is arranged facing the shower area side. This design of the hollow sections results in a simple securing of the stationary door panel parts and, to a great extent, prevents the spraying out of water through the unavoidable gaps at the upper and lower edge of the hinged door panel part.

According to a further characteristic of the invention it is provided that the anchoring arrangements for the stationary door panel part are designed from a guide cross-piece arranged on the section of the hollow portion and the section of the hollow section opposite this guide cross-piece. Expediently, on the sections of the hollow portions, which form the upper and bottom surfaces of the frame, guide cross pieces should also be arranged in the area of the stationary door panel portion, whereby a satisfactory position stability is achieved.

It is further proposed that the height of the guide cross-pieces is smaller than that of the sections opposite the hollow section. In this way it is prevented that the water that collects between guide cross-pieces and the sections opposite can pass outward.

Since the frame can now be designed all around from hollow sections, it is proposed according to a further characteristic of the invention that these hollow sections are secured on the corners by the corners connectors. Through this connection an especially high watertightness at the corner joints, which are always endangered in this respect, is achieved. Furthermore, this also has finishing technical advantages since the profile must no longer be cut on a miter. Finally, the assembly of a complete frame can be easily achieved.

In formation of this proposal it is provided that, in case the hollow sections are designed L-shaped, their sections are formed equi-sided. In this way the corner connectors can be constructed symmetrically so that they are insertable in any position.

Finally, the invention provides that the corner connectors each consists of a piece corresponding to the outside contour of the hollow sections contiguous thereto and on which there is formed for every hollow section a telescopic piece corresponding to its hollow section and insertable into it. This measure especially serves appearance purposes since the corner connectors blend themselves harmoniously into the course of the hollow sections.

Figure 2:
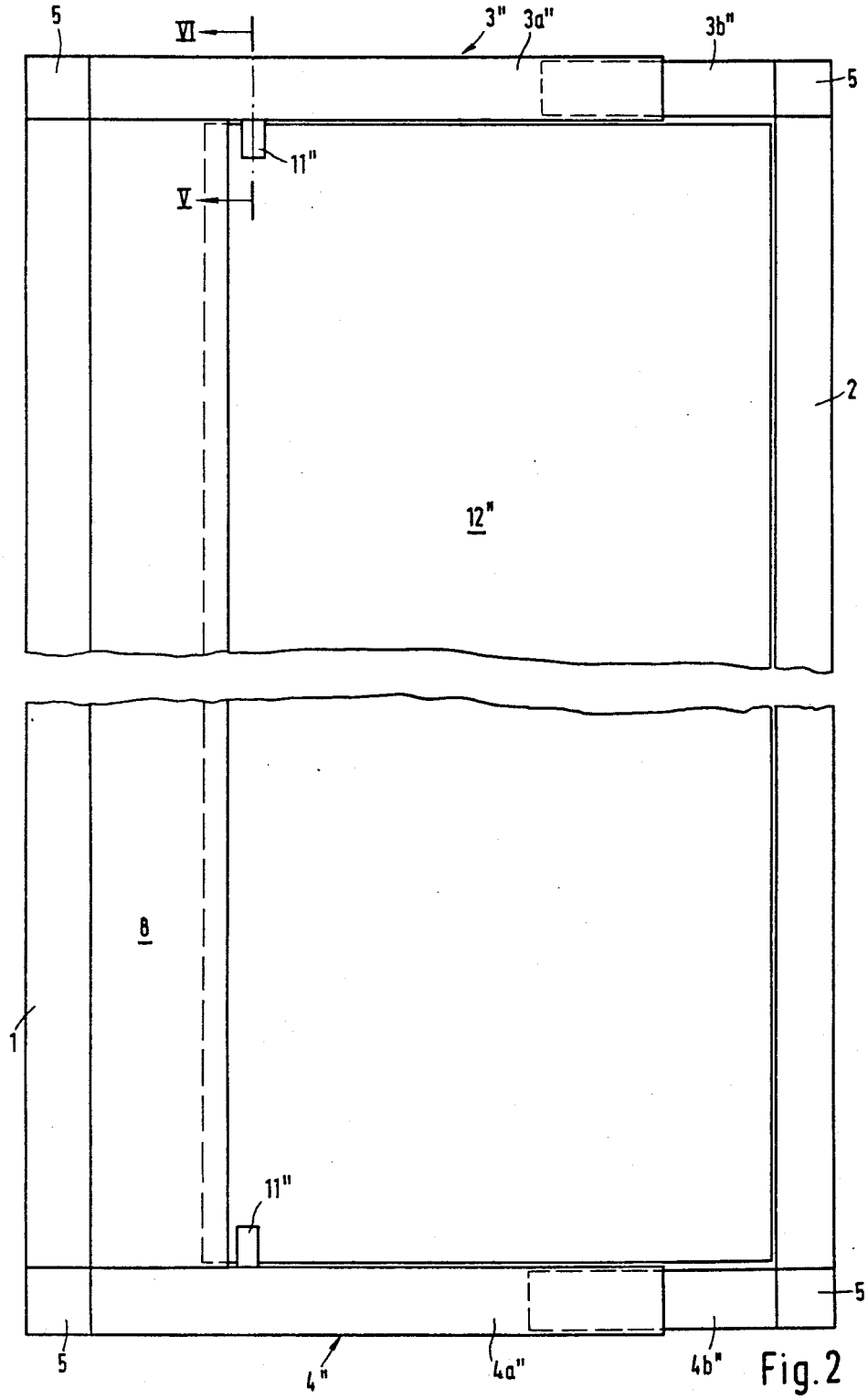
Figure 3:
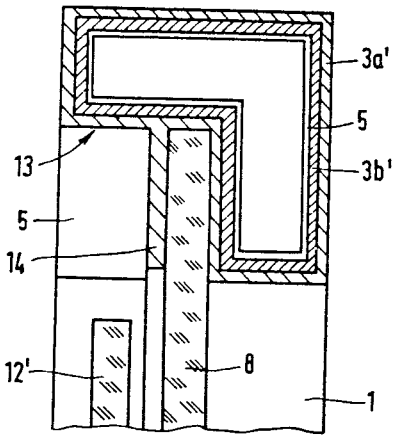
Figure 4:
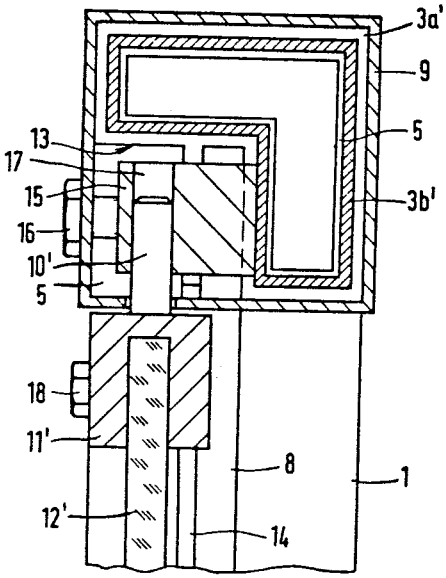
Figure 5:
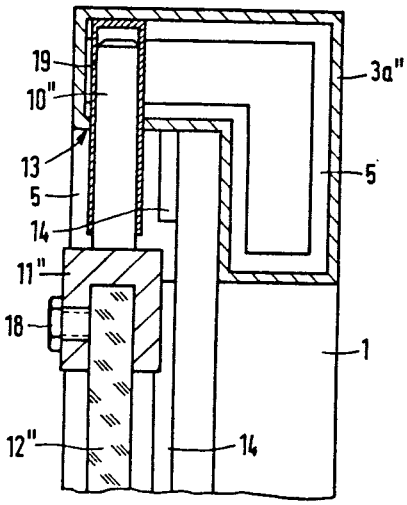
Figure 6:
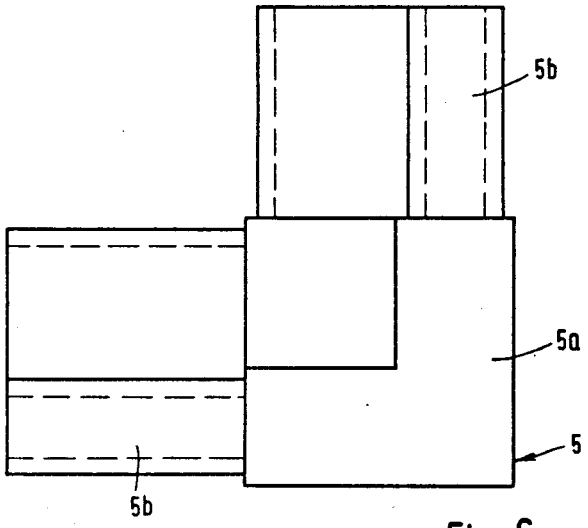
Figure 7:
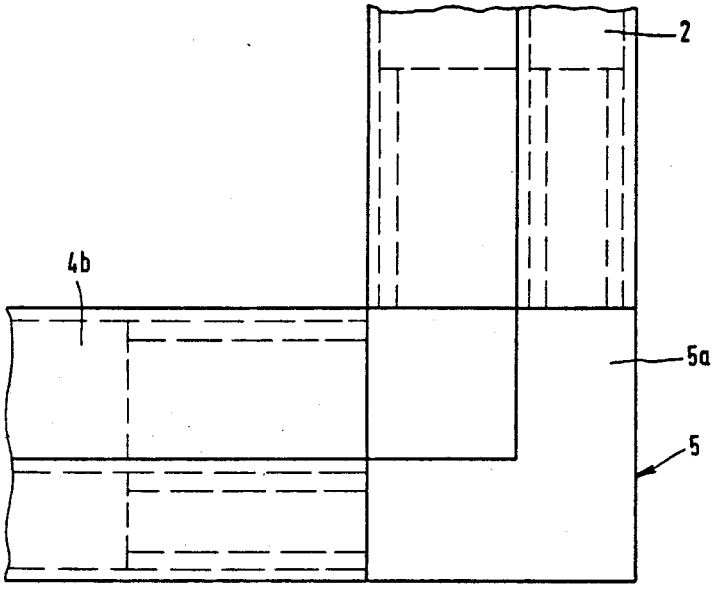
Figure 8:
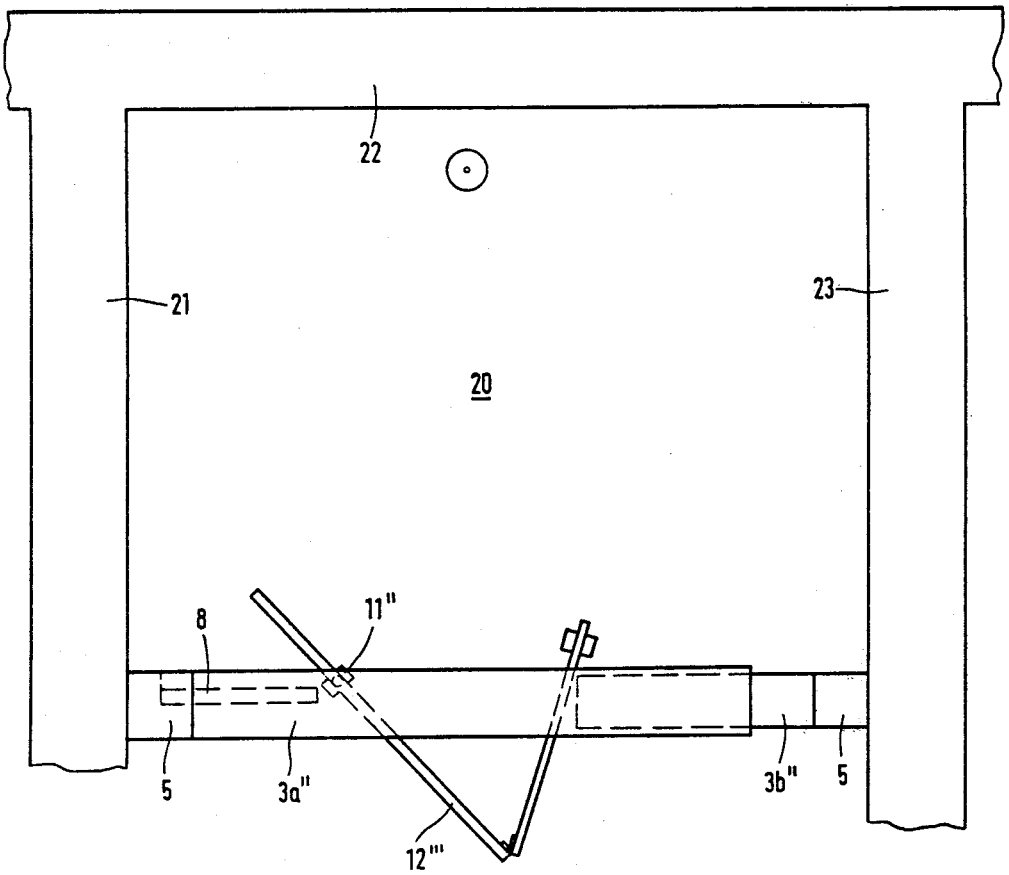

In the drawing the invention is represented more closely by an exemplary modification in which FIG. 1: Outside view of an entrance or passage door;

FIG. 2: Outside view of a further exemplary form of an entrance or passage door;

FIG. 3: Section through the upper side of the structure according to FIG. 1 in the plane I–II;

FIG. 4: Section through the upper side of the structure according to FIG. 1 in the plane III–IV;

FIG. 5: Section through the upper side of the structure according to FIG. 2 in the plane V–VI;

FIG. 6: Elevation of a corner connector;

FIG. 7: Partial elevation of a corner connection of the frame profiles;

FIG. 8: Top view onto an entrance or passage door as a recess separation.

In the drawings, identical parts are designated by identical reference characters and different exemplary forms of parts which perform the same function, by corresponding superscripted numerals. The door structure shown in FIG. 1 in the outside view is provided for a shower stall and specifically for a recess separation. The structure shows longitudinal sides 1 and 2 as well as an upper side 3', and a bottom surface 4'. These sides 1 through 4' consist of rustproof material and are formed as hollow sections which are joined across corner connectors 5 at the corner joints.

On the left longitudinal side 1 in the view and the profile portions 3a' or 4a' directly secured on this longitudinal side of the upper surface 3' and the bottom surface 4' of the frame a stationary door panel 8 of safety glass is secured, which conceals a portion of a passage opening. The outlet of the inner profile portions 3b' or 4b' from the outer profile portions 3a' or 4a' includes a sleeve-like manner an holder 9 which is provided as a holder for the pivots 10', which in turn are joined across a U-shaped fitting 11', each adjustable with the hinged door plate panel 12'. This hinged door plate part 12' completely conceals the remaining passage opening when closed and overlaps thereby with the stationary door panel part 8.

The adjustment of the structure to the present width of the shower recess proceeds in the following manner. First the inner profile portions 3b' or 4b' are extended out of the outer profile portions 3a' and 4a' to the extent that both longitudinal sides 1 and 2 of the frame rest against the walls opposite forming the recess. After fixing the longitudinal sides 1 and 2, the holders 9 are joined with both profile portions 3a' and 3b' as well as 4a' and 4b' and specifically by means of a clamp reinforcement, and the fittings 11' are inserted with the pivots 10' into the holders 9. Subsequently, the hinged door panel part 12' is slid into the U-shaped fittings 11' until it terminates in enclosed state with the right longitudinal side 2 in this view, and then stops.

The range of adjustment corresponds thereby to approximately the width of the stationary door panel portion 8, since both door plate portions 8 or 12 must overlap each other at least slightly.

In FIG. 2 a further exemplary form of a shower stall is presented in the form of an entrance or passage door, and specifically in the same view as in FIG. 1. This exemplary form essentially differs from that shown in FIG. 1 by the other design of the profile portions 3a'' and 3b'' or 4a'' and 4b'' and of the holder for the pivot 10''.

Here the outer profile portions 3a'' and 4a'' are formed longer and correspond to the width of the hinged door panel part 12'' so that in the place with the smallest opening width, the inner profile portions 3b'' and 4b'' are completely inserted into the outer profile portions 3a'' and 4a''. In this way, in contrast to the exemplary form shown in FIG. 1, it is possible to form the inner profile portions 3b'' and 4b'' longer than the range of adjustment, whereby even in the place extended the furthest a sufficiently long piece remains in the outer profile portions 3a'' and 4a'' and thus provides for a good mutual guiding of the telescoping profile portions 3a'' and 3b'' and 4a'' and 4b'' inserted into one another. The fixation can take place, for example, across a bolt, or something similar, driven in, penetrating both profile portions.

The fittings 11'' are kept narrower for reasons which shall be shown in FIG. 5. In this way the gas on the upper and bottom edge of the hinged door panel portion 12'' can be kept as small as possible. The holders for the pivots are not seen in this view but are as shown in FIG. 4.

FIG. 3 shows a section through the upper surface 3' of the frame in the plane I–II according to FIG. 1. The profile portions 3a' and 3b' have, as do all other frame profiles, and L-shaped cross-section with equally long horizontal and vertical sides. On the basis of this cross-section a section 13 is formed facing the shower area side on which is provided a vertically extending guide cross-piece 14. This guide cross-piece 14, together with the vertical sides of the outer profile portion 3b' running parallel forms the holder for the stationary door panel part 8, which continue in the same form as the longitudinal side 1. Since the sectional plane I–II lies in the overlapping region of both door panel portions 8 and 12', there is also a part of the hinged door panel portion 12' to be seen in this view.

In FIG. 4 a section through the upper side 3' of the structure is also shown and specifically in the plane III–IV according to FIG. 1. The section shows the construction of the holder 9 for installation of the pivot 10', which is formed as an enclosed, right-angled installation profile 9 pushed across the outer profile portion 3a'. It includes, as already shown in FIG. 1, the outlet of the inner profile portion 3b' from the outer profile portion 3a'.

In the free cross-section which resulted between the L-shaped profile portions 3a' and 3b' and the right-angled holder 9, a clamping piece 15 is arranged, which is pressed by the clamping screws 16 against the vertical sides of both profile portions 3a' and 3b . To this the clamping piece 15 corresponding to the differing cross-sections of both profile portions 3a' and 3b' is offset so that it touches both vertical sides of these profile portions 3a' and 3b' level. Not only the installation profile 9 is fixed in position by this clamp fastening, but the profile portions 3a' and 3b' are also secured between one another.

In the clamping piece 15 there is a bore 17 in which the pivot 10' is positioned hingedly. The pivot 10' is pressed against the hinged door plate part 12' across a U-shaped fitting 11' by means of a securing screw 18.

FIG. 5 illustrates a section through the holder arrangement of the exemplary form according to FIG. 2 and specifically in the plane V–VI. The holder arrangement consists here only of a tubular centerplate 19 which is inserted into the section 13 of the outer profile portion 3a'' and is formed enclosed on its inner end. The pivot 10'' is enclosed in the centerplate 19. As already can be seen in FIG. 2, the U-profile of the fitting 11'' is formed relatively narrow so that it can still be hinged within the area of the vertical section of the profile portion 3a'' without striking against this section. In this way the distance between the upper edge of the hinged door panel part 12'' and the lower edge of the profile portion 3a'' can be kept as small as desired so that especially on the similarly formed bottom side of the structure practically no additional water can exit. In addition to this, an adjusting divice can be installed on the pivot secured on the bottom edge of the hinged door panel part 12'', across which this gap can be adjusted correspondingly.

FIG. 6 shows a corner connector 5 in the view. It consists of a corner piece 5a, that is fitted onto the outer contour of the profile portions which are contiguous as well as adjusted onto the telescopic pieces 5b tip-stretched on the left side and the upper side, whose external cross-sections are adapted to the inner contour of the profile portion. A further telescopic piece 5b could still be installed on the side of the cornerpiece located in the drawing plane so that three profile portions could also be joined through the corner connector 5 contiguous at a right angle.

Through this construction this corner connector fits harmoniously into the structure, as can be seen in FIG. 7. In FIG. 7, the left lower corner of the frame is shown from the shower room out, whereby the telescopic pieces inserted into the profile portion 4b and side portion 2 are sketched dotted. With this kind of connection of the corner joints of the individual frame profiles, an absolute watertightness is achieved at the previously critical location. In addition, numerous specific embodiments of shower cabins with this kind of corner connector 5 can be produced in a simple manner without having to produce special profiles.

In FIG. 8 a schematic presentation of the shower cabin door according to the invention is shown for the exemplified embodiment of a recess separation in top-plan view. A shower compartment 20 is surrounded on three sides by walls, 21, 22 and 23. The fourth side is partitioned off by a door according to the invention which corresponds in construction to that shown in FIG. 2. The longitudinal sides 1 and 2 are mounted on the walls 21 and 23 and joined together by the upper side 3'' and not visible bottom surface 4''. The structure can be inserted exactly into passage opening at hand between the walls 21 and 23 by the telescoping adjustability across the telescoping profile portions 3a'' and 3b'' or not visible 4a'' and 4b which are adjustable in one another. In contrast to the exemplary modification shown in FIG. 2, the hinged door panel portion 12''' is divided into two parts in the vertical longitudinal direction, whereby both parts are joined across hinges. Such as exemplary embodiment of the hinged door panel part 12''' is of special advantage when the hinged area is restricted by narrow space relationships. Understandable, by displacement of the point of hinging of the hinged door panel part 12''', it is possible to have both these parts also hinged inward.

I claim:

1. Entrance or passage door, especially for shower stalls comprising a frame of rust free material, said frame including spaced parallel vertical members and spaced parallel horizontal connecting members, said connecting members each including a pair of telescoping elements adjustable in one another for varying the width of said frame, means for locking said elements in positions, a stationary door panel mounted on one of said vertical members, a hinged door panel overlapping said stationary door panel at least slightly, and hinge means on one of said connecting elements of each of said connecting members for pivotally mounting said hinged door panel.

2. Entrance or passage door as in claim 1 and wherein the length of said ones of said connecting elements is greater than the width of said stationary door panel and equal to or less than the width of said hinged door panel.

3. Entrance or passage door as in claim 2 and wherein said locking means includes a holder encircling the connecting elements secured to said one of said vertical elements.

4. Entrance or passage door as in claim 3 and including clamp means within said holder for clamping said connecting elements in position and for mounting said hinge means.

5. Entrance or passage door as in claim 4 and wherein said holder surrounds the region where the inner connecting element enters the outer connecting element and is lockable to both of said connecting elements.

6. Entrance or passage door as in claim 5 and wherein said holder is so configured as to mate with both the inner and outer of said telescoping connecting elements.

7. Entrance or passage door as in claim 6 and wherein said hinge means comprises a pivot bearing.

8. Entrance or passage door as in claim 7 and wherein said pivot bearings are secured on the outer side of the respective connecting elements.

9. Entrance or passage door as in claim 3 and wherein each of said members is hollow and has a closed cross-sectional configuration.

10. Entrance or passage door as in claim 9 and wherein each of said members has an L-shaped cross-sectional configuration.

11. Entrance or passage door as in claim 10 and wherein one of said connecting elements includes a flange (14) forming with a portion of said one of said connecting elements a channel for mounting said stationary door panel.

12. Entrance or passage door as in claim 9 and wherein said vertical members and said horizontal connecting members are joined by corner connectors.

13. Entrance or passage door as in claim 12 and wherein said corner connectors each include a portion insertable into the respective member and the outer surface of said corner connectors are of substantially the same dimensions as the outer surface of the mating members.

* * * * *